United States Patent [19]

Mori et al.

[11] Patent Number: 4,755,310

[45] Date of Patent: Jul. 5, 1988

[54] SILICONE GREASE COMPOSITION CONTAINING A CHLORINATED ALICYCLIC COMPOUND

[75] Inventors: Shigeru Mori, Annaka; Masanobu Kimura, Yokohama, both of Japan

[73] Assignee: Shin-Etsu Chemical Co., Ltd., Tokyo, Japan

[21] Appl. No.: 55,182

[22] Filed: May 28, 1987

[30] Foreign Application Priority Data

Jun. 2, 1986 [JP] Japan ..... 61-127697

[51] Int. Cl.[4] ..... C10M 131/06; C10M 103/00

[52] U.S. Cl. ..... 252/49.6; 252/58

[58] Field of Search ..... 252/49.6, 58

[56] References Cited

U.S. PATENT DOCUMENTS 2,971,913 2/1961 David et al. ..... 252/58

3,072,571 1/1963 Jordan et al. ..... 252/58

3,410,916 11/1968 Bruson et al. ..... 252/49.6

*Primary Examiner*—William R. Dixon, Jr.

*Assistant Examiner*—Jerry D. Johnson

*Attorney, Agent, or Firm*—Hopgood, Calimafde, Kalil, Blaustein & Judlowe

[57] ABSTRACT

The inventive silicone grease composition has markedly improved lubrication characteristics under extreme-pressure conditions, greatly extended durability at high temperatures and little corrosiveness against metals in comparison with conventional silicone greases. The inventive silicone grease composition contains, in addition to an organopolysiloxane fluid as the base oil and a thickening agent, a specific chlorinated alicyclic compound 1,2,3,4,7,8,9,10,13,13,14,14-dodecachloro-1,4,4a,5,6a,7,10,10a,11,12,12a-dodecahydro-1,4;7,10-dimethanodibenzo [a,e] cyclooctane in a substantial amount.

4 Claims, No Drawings

SILICONE GREASE COMPOSITION CONTAINING A CHLORINATED ALICYCLIC COMPOUND

BACKGROUND OF THE INVENTION

The present invention relates to a silicone grease composition or, more particularly, to a silicone grease composition having an improved characteristic of extreme-pressure lubrication in steel-to-steel friction.

As is well known, silicone oils, i.e. organopolysiloxane fluids, have excellent properties including very low temperature dependency of viscosity, high resistance against heat and oxidation, high stability under shearing, chemical stability and so on. These properties are important factors in lubricating oils so that silicone oils are widely used as a lubricating oil in some applications. Similarly, silicone greases prepared from a silicone oil as the base oil also have very low temperature dependency of the consistency and high resistance against heat and oxidation as well as high chemical stability.

Silicone greases, of course, are not free from some problems, of which the largest is the poor boundary lubrication for steel-to-steel friction in comparison with greases of other types prepared from a mineral oil or synthetic oil as the base oil. Therefore, no satisfactory lubrication can be obtained with a silicone grease for friction under high-speed sliding or under high contacting pressure so that the fields of application of silicone greases are limited in this regard.

Various attempts and proposals have been hitherto made to improve the boundary lubrication of silicone greases by admixing the grease or the silicone oil as the base oil with certain additives called an oiliness improver or extreme-pressure additive. Such additives hitherto proposed include fatty acids and derivatives thereof, chlorinated and fluorinated organic compounds, organic compounds of boron, lead, manganese, tin and the like, and so on. For example, Japanese Patent Publication No. 51-38864 teaches admixture of a silicone grease with a chlorinated paraffin or a dialkyl chlorendate as a class of chlorinated organic compounds. These chlorine-containing additives are indeed effective in improving the boundary lubrication of silicone greases but are not practical due to the very disadvantageous corrosiveness against metals at elevated temperatures prohibiting the use of such a silicone grease at a high temperature or under an oxidizing condition.

SUMMARY OF THE INVENTION

An object of the present invention is therefore to provide a novel silicone grease composition capable of giving good extreme-pressure lubrication to the steel-to-steel friction without the problem of corrosiveness against metals even at high temperatures.

Thus, the silicone grease composition of the present invention comprises:

(A) from 40 to 90 parts by weight of an organopolysiloxane fluid represented by the average unit formula $$R_aSiO_{(4-a)/2}, \quad (I)$$

in which R is a monovalent hydrocarbon group and the subscript a is a positive number in the range from 1.90 to 2.20;

(B) from 2 to 40 parts by weight of a thickening agent; and (C) from 3 to 30 parts by weight of a chlorinated alicyclic compound which is 1,2,3,4,7,8,9,10,13,13,14,14-dodecachloro-1, 4,4*a*,5,6-,6*a*,7,10,10*a*,11,12,12a-dodecahydro1,4;7,10-dimethanodibenzo [a,e] cyclooctane expressed by the structural formula

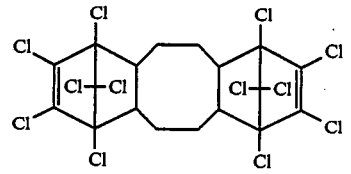

(II)

total amount of the components (A), (B) and (C) being 100 parts by weight.

DETAILED DESCRIPTION OF THE PREFERRED EMBODIMENTS

As is described in the above given summary of the invention, the most characteristic ingredient in the inventive silicone grease composition is the very specific chlorinated organic compound as the component (C). In comparison with conventional chlorinated paraffins and dialkyl chlorendates, this particular chlorinated alicyclic compound is highly heat-resistant at high temperatures with much smaller evolution of chlorine or hydrogen chloride as a decomposition product of the compound so that a great improvement can be obtained in the extreme-pressure lubrication between steel-made parts with little corrosion of the metal surface even at high temperatures. Accordingly, machines can be lubricated with the inventive silicone grease composition even in an extreme-pressure condition at high speed and under high load so that the durability of the lubricated machine can be greatly extended without the problem due to corrosion of metal-made parts to greatly decrease the costs for maintenance of the machine.

The component (A) is an organopolysiloxane which serves as the base oil of the grease composition and is represented by the average unit formula (I) given above, in which the symbols R and a each have the meaning defined above. The monovalent hydrocarbon group denoted by R is preferably an alkyl group such as methyl or an aryl group such as phenyl. It is more preferable that the organopolysiloxane is a methyl phenyl polysiloxane of which, for example, about 2% to about 30% by moles of the monovalent hydrocarbon groups are phenyl groups, the balance being methyl groups. The value of the subscript a from 1.90 to 2.20 means that the organopolysiloxane should have a substantially linear molecular structure although a small number of branches may be contained in the molecule.

The component (B) is a thickening agent which may be any of conventional ones used in the preparation of silicone greases including metal soaps, e.g., lithium stearate, finely pulverized resinous materials, e.g., fine powders of poly(tetrafluoroethylene) resins, and the like.

The specific additive as the component (C) is 1,2,3,-4,7,8,9,10,13,13,14,14-dodecachloro-1,4,4*a*,5,6,6*a*,7,10,-10*a*,11,12,12a-dodecahydro-1,4;7,10dimethanodibenzo [a,e] cyclooctane which is expressed by the structural formula (II) given above and available as a commercial product useful as a flame retardant additive in various polymeric materials such as molded articles of synthetic resins and rubbers. For example, two commercial grades of the compound are sold by Hooker Chemical Corp., U.S.A., under a trade name of Dechlorane Plus with different particle size distributions, one, in the range from 2 to 5 μm and, the other, in the range from 5 to 15 μm. The product of the finer particle size distribution grade is preferred as the component (C) in the inventive silicone grease composition.

In connection with the relative amount of the component (C) in the inventive silicone grease composition, the composition should comprise from 40 to 90 parts by weight of the component (A), from 2 to 40 parts by weight of the component (B) and from 3 to 30 parts by weight of the component (C). When the amount of the component (C) is too small relative to the other components, no noticeable improvement can be obtained in the boundary lubrication of the grease composition. When the amount thereof is too large, on the other hand, an adverse influence is caused in the lubrication with the grease composition due to increase in the torque. The silicone grease composition of the invention can be prepared from the above described components (A), (B) and (C), optionally, together with other known additives according to a known procedure.

In the following, the silicone grease composition of the invention is described in more detail by way of examples, in which the term of "parts" always refers to "parts by weight" and the values of viscosity are all those obtained by the measurement at 25° C.

EXAMPLE 1 AND COMPARATIVE EXAMPLE 1

A silicone grease composition, which is referred to as the grease I hereinbelow, was prepared by admixing a base grease compounded from 68 parts of a methyl phenyl polysiloxane fluid having a viscosity of 1000 centistokes, of which 95% and 5% by moles of the organic groups bonded to the silicon atoms were methyl and phenyl groups, respectively, as the component (A) and 15 parts of lithium stearate as the component (B) with 17 parts of 1,2,3,4,7,8,9,10,13,13,14,14-dodecachloro-1,4,4*a*,5,6,6*a*,-7, 10,10*a*,11,12,12a-dodecahydro-1,4;7,10-dimethanodibenzo [a,e]cyclooctane as the component (C). This compound was the commercial product of Dechlorane Plus having an average particle diameter of 2.5 μm.

For comparison, another silicone grease composition, referred to as the grease II hereinbelow, was prepared by compounding 85 parts of the same methyl phenyl polysiloxane fluid as used above and 15 parts of lithium stearate.

The greases I and II were subjected to the lubrication test using a Soda-type high-speed four-ball friction tester to compare the wear marks formed on ½-inch steel balls after 5 minutes running at a velocity of 2400 rpm under a load of 40 kg. The results were that the diameter of the wear mark was 1.20 mm with the grease I while the diameter with the grease II was 2.65 mm leading to a conclusion that the lubrication behavior of the grease I was greatly improved under the extreme-pressure condition in comparison with the grease II.

EXAMPLE 2 AND COMPARATIVE EXAMPLE 2

A silicone grease composition, which is referred to as the grease III hereinbelow, was prepared by admixing a base grease compounded from 55 parts of a methyl phenyl polysiloxane fluid having a viscosity of 450 centistokes, of which 75% and 25% by moles of the organic groups bonded to the silicon atoms were methyl and phenyl groups, respectively, as the component (A) and 30 parts of a fine powder of poly(tetrafluoroethylene) resin having an average diameter of the primary particles of about 0.3 μm as the component (B) with 15 parts of 1,2,3,4,7,8,9,10,-13, 13,14,14-dodecachloro-1,4,4*a*,5,6-,6*a*,7,10,10*a*,11,12,12a-dodecahydro-1,4;7,10-dimethanodibenzo [a,e] cyclooctane as the component (C), which was the same commercial product as used in Example 1. For comparison, another silicone grease composition, referred to as the grease IV herein below, was prepared by omitting the component (C) from 70 parts of the same methyl phenyl polysiloxane fluid and 30 parts of the same poly(tetrafluoroethylene) powder.

Each of the greases III and IV was subjected to the durability test by driving a steel bearing of Type 6204 with tooled plates on both surfaces filled with 1 g of the grease. The driving conditions of the bearing included: velocity of revolution of 10,000 rpm; thrust load of 2.27 kg; radial load of 2.25 kg; and temperature of the outer ring of the bearing of 250° C. Running of the bearing filled with the grease III could be continued until seizure took place after 550 hours while the corresponding length of time was only 113 hours of the bearing filled with the grease IV leading to a conclusion that the grease III had greatly improved durability in comparison with the grease IV.

COMPARATIVE EXAMPLE 3

A silicone grease composition, referred to as the grease V hereinbelow, was prepared by compounding 68 parts of the same methyl phenyl polysiloxane fluid as used in Example 1, 17 parts of a chlorinated paraffin, of which the content of chlorine was 70% by weight, and 15 parts of lithium stearate.

Test panels of steel polished with a sandpaper were coated each with the grease I, III or V and kept for 24 hours in a hot-air circulation oven at 200 ° C. After cooling and removal of the grease by wiping, the surface condition of the test panels was visually inspected to find almost no noticeable changes of rust or discoloration on the panels coated with the greases I and III. On the contrary, remarkable corrosion of the steel surface was noted on the area coated with the grease V and the periphery of the coated area on the test panel. The results of this corrosion test led to a conclusion that the inventive silicone grease composition was greatly improved in respect of corrosiveness against metals.

What is claimed is:

1. A silicone grease composition which comprises:

(A) from 40 to 90 parts by weight of an organopolysiloxane fluid represented by the average unit formula $$R_aSiO_{(4-a)/2},$$

in which R is a monovalent hydrocarbon group and the subscript a is a positive number in the range from 1.90 to 2.20;

(B) from 2 to 40 parts by weight of a thickening agent; and (C) from 3 to 30 parts by weight of a chlorinated alicyclic compound which is 1,2,3,4,7,8,9,10,13,13,14,-14-dodecachloro-1,4,4*a*,5,6,6*a*,7,10,10*a*,11,12,12a-dodecahydro-1,4;7,10-dimethanodibenzo [a,e] cyclooctane expressed by the structural formula

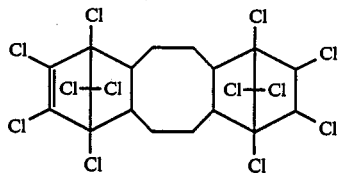

total amount of the components (A), (B) and (C) being 100 parts by weight.

2. The silicone grease composition according to claim 1 wherein the organopolysiloxane fluid as the component (A) is a methyl phenyl polysiloxane in which from 2 to 30% by moles of the monovalent hydrocarbon groups denoted by R are phenyl groups, the balance being methyl groups.

3. The silicone grease composition according to claim 1 wherein the thickening agent as the component (B) is lithium stearate or a fine powder of poly(tetrafluoroethylene) resin.

4. The silicone grease composition according to claim 1 wherein the chlorinated alicyclic compound as the component (C) has a particle size distribution in the range from 2 to 5 μm.

* * * * *